US010227990B2

(12) United States Patent
Williams

(10) Patent No.: US 10,227,990 B2
(45) Date of Patent: Mar. 12, 2019

(54) BEARING AND METHOD OF MAKING AND USING THE SAME

(71) Applicant: BorgWarner Inc., Auburn Hills, MI (US)

(72) Inventor: Jonathan Williams, Clinton, TN (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/587,874

(22) Filed: May 5, 2017

(65) Prior Publication Data

US 2018/0320702 A1 Nov. 8, 2018

(51) Int. Cl.

| | |
|---|---|
| ***F04D 29/057*** | (2006.01) |
| ***F04D 29/053*** | (2006.01) |
| ***F04D 17/10*** | (2006.01) |
| ***F04D 29/28*** | (2006.01) |
| ***F01D 5/04*** | (2006.01) |

(52) U.S. Cl.

CPC ..... *F04D 29/057* (2013.01); *F01D 5/04* (2013.01); *F04D 17/10* (2013.01); *F04D 29/053* (2013.01); *F04D 29/284* (2013.01); *F05D 2220/40* (2013.01); *F05D 2230/00* (2013.01); *F05D 2240/53* (2013.01)

(58) Field of Classification Search

CPC .... F04D 29/057; F04D 29/053; F04D 29/284; F04D 17/10; F01D 5/04; F01D 25/125; F01D 25/16; F04B 39/0253; F05D 2240/53; F05D 2220/40; F05D 2230/00

See application file for complete search history.

(56) References Cited

U.S. PATENT DOCUMENTS

| | | | | |
|---|---|---|---|---|
| 2,338,084 | A * | 1/1944 | Edmunds | F02B 75/28 123/41.31 |
| 3,993,370 | A | 11/1976 | Woollenweber | |
| 4,784,586 | A | 11/1988 | Ho | |
| 5,026,260 | A * | 6/1991 | Gutknecht | F01D 25/125 184/6.11 |
| 6,231,302 | B1 * | 5/2001 | Bonardi | F01D 25/22 415/105 |
| 8,096,127 | B2 * | 1/2012 | Ono | F01D 25/16 415/119 |
| 2013/0323020 | A1 | 12/2013 | Bogner et al. | |
| 2014/0090375 | A1 | 4/2014 | Kanzaka et al. | |
| 2014/0369811 | A1 | 12/2014 | Malins et al. | |
| 2015/0000272 | A1 | 1/2015 | Balsley, II | |
| 2015/0093238 | A1 | 4/2015 | Kanbara et al. | |
| 2016/0265545 | A1 * | 9/2016 | Ueda | F25B 9/002 |

FOREIGN PATENT DOCUMENTS

WO 2015002774 A1 1/2015

* cited by examiner

*Primary Examiner* — Dwayne J White
*Assistant Examiner* — Adam W Brown
(74) *Attorney, Agent, or Firm* — BrooksGroup

(57) ABSTRACT

A number of variations may include a product including a rotor comprising a shaft having a rotation axis, a bearing at least partially surrounding the shaft allowing for rotation of the shaft within the bearing about the rotation axis, and a bearing housing comprising at least one fluid outlet passage constructed and arranged to flow fluid upward from the bearing to a top side of the bearing housing.

18 Claims, 4 Drawing Sheets

BEARING AND METHOD OF MAKING AND USING THE SAME

TECHNICAL FIELD

The field to which the disclosure generally relates to includes bearings and method of making and using the same and in particular bearings for rotational movement systems including, but not limited to, vehicle components.

BACKGROUND

In some variations, vehicles may include turbochargers which may include a bearing to support a shaft rotation of a turbine wheel and/or a compressor wheel within a turbocharger housing.

SUMMARY OF ILLUSTRATIVE VARIATIONS

A number of variations may include a product comprising: a rotor comprising a shaft having a rotation axis, a bearing at least partially surrounding the shaft allowing for rotation of the shaft within the bearing about the rotation axis, and a bearing housing comprising at least one fluid outlet passage constructed and arranged to flow fluid upward from the bearing to a top side of the bearing housing.

A number of variations may include a method comprising: providing a product comprising a rotor comprising a shaft having a rotation axis, a bearing at least partially surrounding the shaft allowing for rotation of the shaft within the bearing about the rotation axis, and a bearing housing comprising at least one fluid outlet passage constructed and arranged to flow fluid upward from the bearing to a top side of the bearing housing; and flowing fluid through the least one fluid outlet passage upward from the bearing to a top side of the bearing housing while the shaft is in rotation.

Other illustrative variations within the scope of the invention will become apparent from the detailed description provided hereinafter. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

Figure 1A:
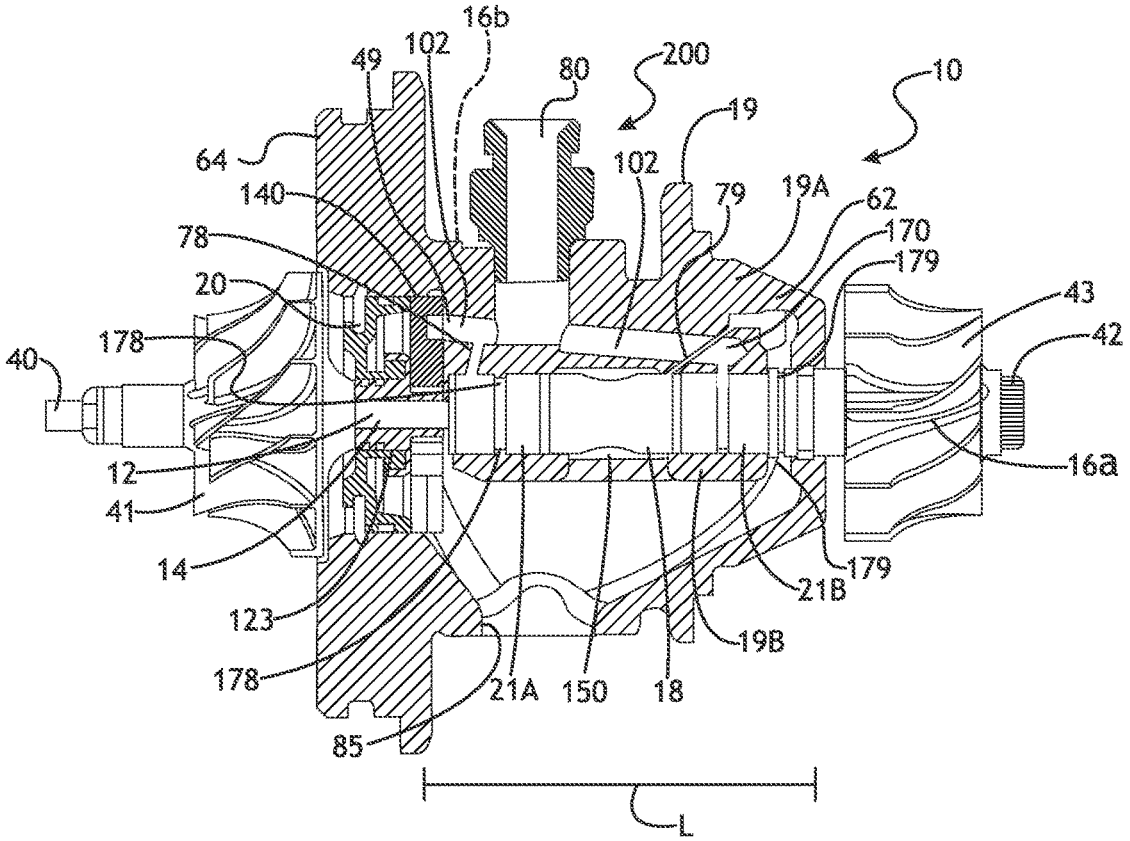
FIG. 1A is a cross sectional illustration of a product according to a number of variations.
Figure 1B:
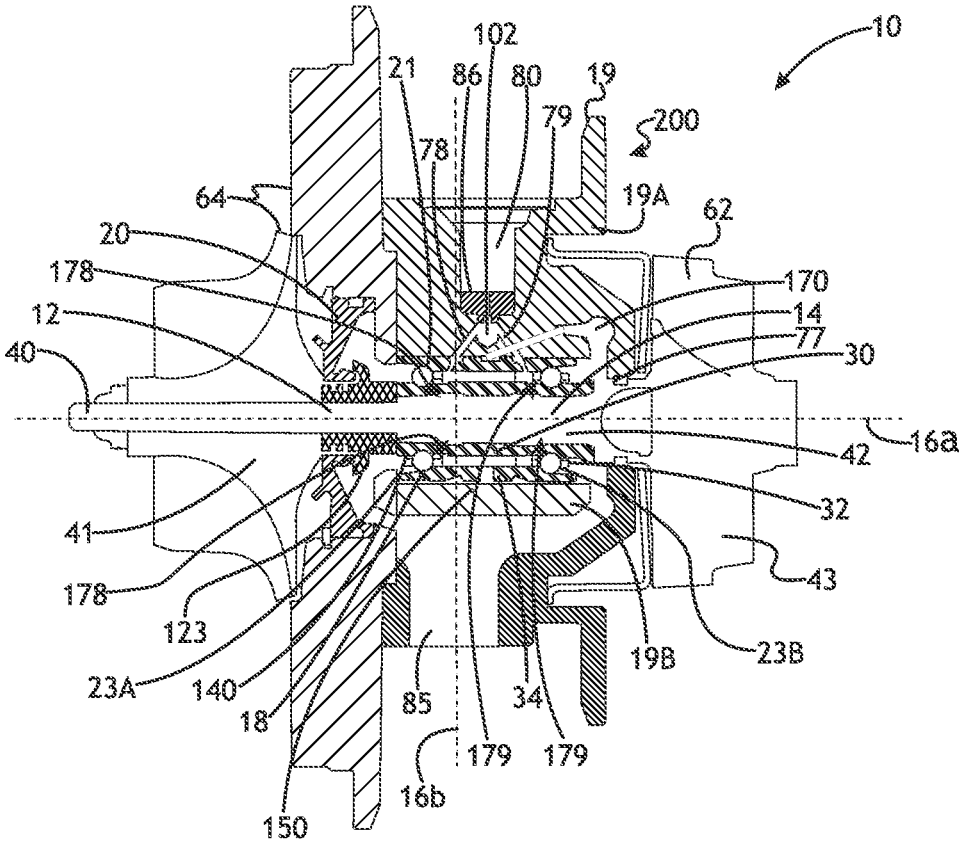
FIG. 1B is a cross sectional illustration of a product according to a number of variations.

FIGS. 1A-1B illustrate a product 10 according to a number of variations. In a number of variations, the product 10 may include a rotor 12. In a number of variations, the rotor 12 may include a shaft 14 having a rotational axis illustrated by line 16*a*. In a number of variations, the shaft 14 may have a radial axis illustrated by line 16*b*. In a number of variations, the product 10 may further comprise at least one bearing 18 which may at least partially surround the shaft 14. In a number of variations, the bearing 18 may have a length L. In a number of variations, the product 10 may include any component including a bearing 18 at least partially surrounding a shaft 14 and may include, but is not limited to, a centrifuge, a brake, a motor, a turbine, a appliance comprising a rotating component, or may be another type. In a number of variations, the product 10 may comprise a turbocharger. In a number of variations, the product 10 may be a turbocharger used in a vehicle. In a number of variations, the vehicle may include a motor vehicle, watercraft, spacecraft, aircraft, or may be another type. In a number of variations, the product 10 may be another device including a rotor including, but not limited to, a gas turbine, a turboprop engine, an auxiliary power unit, a turboshaft engine, a radial turbine, an axial turbine, a radial compressor, an axial compressor, a supercharger, a pump, a drilling rig, a microturbine, a turbine generator, a magnetic turbocharger, a journal bearing turbocharger system, an oil-free turbocharger bearing system, or may be another device. In a number of variations, the shaft 14 may include a compressor end 40. In a number of variations, the compressor end 40 may include a compressor wheel 41 which may rotate along the rotational axis 16*a*. In a number of variations, the shaft 14 may include a turbine end 42. In a number of variations, the turbine end 42 may include a turbine wheel 43 which may rotate along the rotational axis 16. In a number of variations, the bearing 18 may allow for rotation of the shaft 14 within the bearing 18 along the rotational axis 16*a*. In a number of variations, the product 10 or bearing 18 may include a bearing housing 19. In a number of variations, the bearing housing 19 may include a top side 19A and a bottom side 19B. Referring to FIG. 1A, in a number of variations, the bearing 18 may be a journal bearing. In a number of variations, the bearing 18 may include a first journal bearing 21A and a second journal bearing 21B in the bearing housing 19. In a number of variations, a spacer 150 may be located between the first journal bearing 21A and the second journal bearing 21B. Referring to FIG. 1B, in a number of variations, the bearing 18 may be a rolling element bearing (REB) 23. In a number of variations, the bearing 18 may include a first REB 23A and a second REB bearing 23B in the bearing housing 19. In a number of variations, a spacer 150 may be located between the first REB 23A and the second REB 23B. In a number of variations, the rolling element bearing 18 may include an inner race 30 (or races), an outer race 34 (or races) and at least one rolling element 32. Unless otherwise indicated, the term "race" shall refer to the metal (or ceramic) element with one or more tracks contacted by the rolling elements, and the term "REB" used herein will encompass both types of REB cartridges. In a number of variations, at the compressor end 40, an insert 20 may at least partially annularly surround at least a portion of a thrust collar 123.

Referring to FIGS. 1A-1B, in a number of variations, the bearing housing 19 may include a turbine side housing 62. In a number of variations, the bearing housing 19 may include a compressor side housing 64. In a number of variations, the compressor wheel 41 and the turbine wheel 43 may both be solidly affixed to the shaft 14. In a number of variations, a number of fasteners (not illustrated), may be used to secure the bearing housing 19 to the turbine side housing 62, compressor side housing 64, or any of their individual components. In a number of variations, the product 10 may be fed with a fluid, which may comprise oil or coolant or may comprise another fluid, to perform various functions on the bearing 18, shaft 14, and turbocharger 10 including, but not limited to, lubrication of the shaft 14 or the bearing 18, and/or cooling of all components within the turbocharger 10 including, but not limited to, the shaft 14, bearing, 18, or bearing housing 19. In a number of variations, the pressure, temperature, or flowrate of the fluid may impact the performance of the turbocharger 10. In a number of variations, the fluid may perform the function of providing a hydrodynamic squeeze film which exerts force on the shaft 14 or bearing 18.

Figure 2:
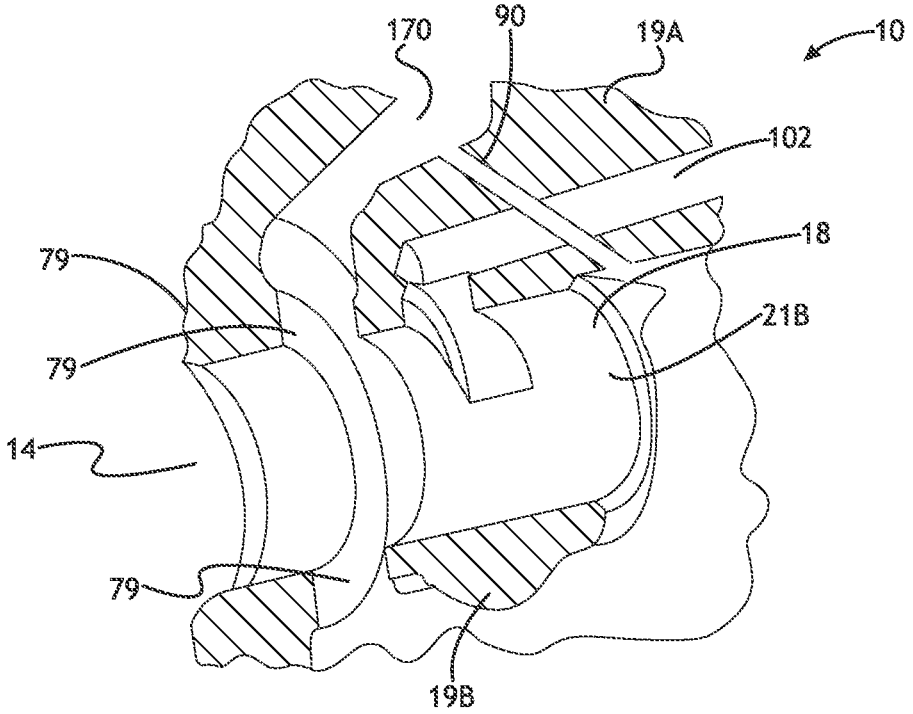
FIG. 2 is a fragmentary outline cross sectional illustration of a product for use with a turbocharger system according to a number of variations.

In a number of variations, the fluid may be introduced to the product through a fluid delivery system 200. In a number of variations, the fluid delivery system 200 that may be provided with a supply line at fitting a fluid inlet 80, which may be interconnected with an associated engine's pressurized oil delivery system. In a number of variations, the oil delivery system 200 may deliver fluid to the bearing housing 19 through the fluid inlet 80. In a number of variations, the fluid inlet 80 may be interconnected with an associated engine's pressurized oil delivery system. In a number of variations, an oil restrictor/post 86 may be fitted to the fluid inlet 80 to restrict the flow of fluid to the bearing housing 19. Referring to FIGS. 1A-2, in a number of variations, the fluid delivery system 200 fluid inlet 80 may spread into at least one fluid delivery system 200 longitudinal passageway 102. In a number of variations, the oil restrictor/post 86 may limit the oil from the fluid inlet 80 to the longitudinal passageway 102. In a number of variations, the longitudinal passageway 102 may be intersected by at least one fluid delivery system 200 fluid inlet passage 78, 79 that may extend around the axis of rotation 16*a* and may interconnect the fluid passageway 102 to the bearing 18. In a number of variations, the longitudinal passageway 102 may provide fluid from the fluid inlet 80 to at least one fluid inlet passage 78, 79. In a number of variations, the fluid inlet passages 78, 79 may take the form of annular grooves or jets that open into a gap to supply the bearing 18 with fluid. In a number of variations, the longitudinal passageway 102 may be cut or cross drilled from the turbine end 42 of the bearing housing 19 and may have a blind end 49. In a number of variations, the longitudinal passageway 102 may provide fluid to a thrust bearing 140. Referring to FIG. 1B, in a number of variations, the fluid may be fed through fluid inlet 80 to the fluid inlet passages 78, 79 to the bearing 18. In a number of variations, secondary fluid outlet passages 178, 179 may feed fluid to the shaft 14 through the bearing 18. In a number of variations, the fluid inlet 80, fluid inlet passages 78, 79 and/or longitudinal passageway 102 may be oriented along the side of the bearing 18 or bearing housing 19. In a number of variations, a plurality of fluid inlets 80, fluid inlet passages 78, 79 and/or longitudinal passageways 102 may be oriented along the side of the bearing 18 or bearing housing 19. In a number of variations, the fluid may be delivered to rotating shaft 14 and potentially rotating bearing 18 through the fluid inlet passages 78, 79 and the secondary fluid outlet passages 178, 179. In a number of variations, the fluid may exit the rotating shaft 14 and potentially rotating bearing 18 through the secondary fluid outlet passages 178, 179 and/or the fluid inlet passages 78, 79 to a fluid drain 85 on the bottom side 19B of the bearing housing 19. In a number of variations, the fluid drain 85 may return fluid to the associated engine.

Figure 3:
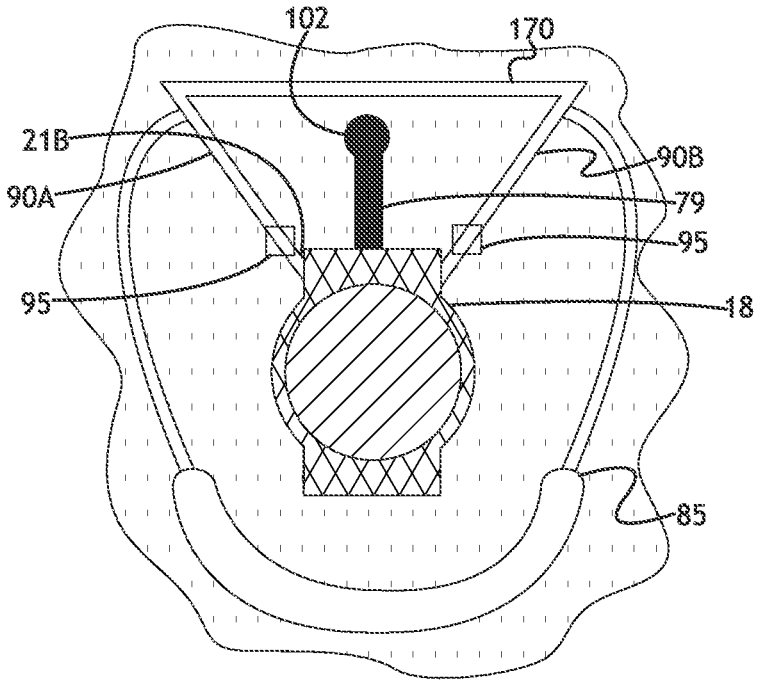
FIG. 3 is a fragmentary outline cross sectional illustration of a product for use with a turbocharger system according to a number of variations.
Figure 4:
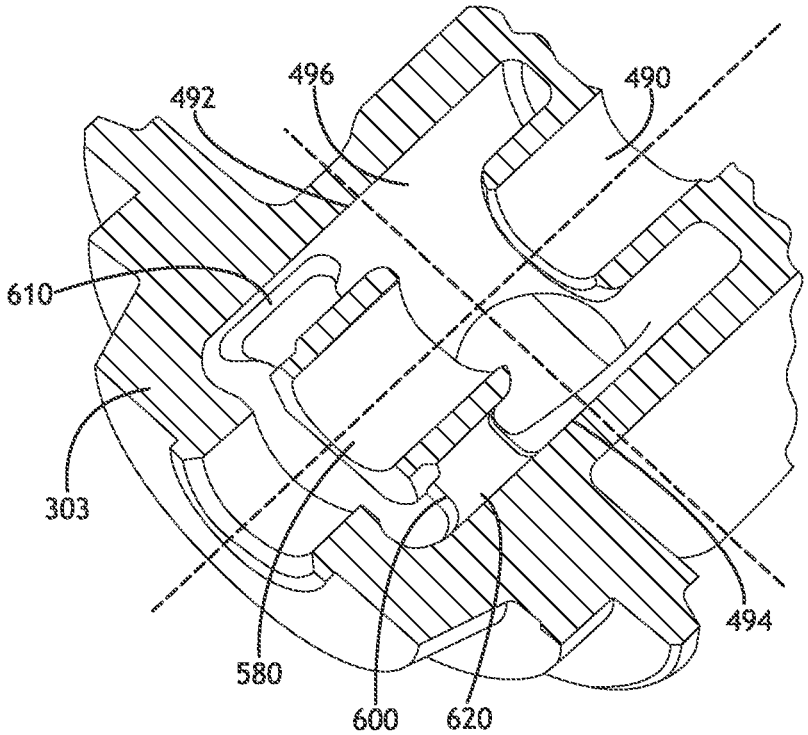
FIG. 4 is a fragmentary outline cross sectional illustration of a product for use with a turbocharger system according to a number of variations.

In a number of variations, the bearing housing 19 may include a housing bore 170. In a number of variations, the housing bore 170 may be located on the top side 19A of the bearing housing 19. In a number of variations, the bearing housing 19 or fluid delivery system 200 may include at least one fluid outlet passage 90. In a number of variations, the bearing housing 19 or fluid delivery system 200 may include a plurality of fluid outlet passages 90. In a number of variations, the fluid outlet passage 90 may be constructed and arranged to flow fluid upward from the bearing 18 to the top side 19A of the bearing housing 19. In a number of variations, the housing bore 170 may be constructed and arranged to accept fluid from the fluid outlet passage 90. In a number of variations, the spacer 150 may eliminate or lessen the surface area, cross-sectional area or total volume of the fluid outlet passages 178, 179 such that fluid may only flow or substantially only flow upwards through the fluid outlet passage 90. In a number of variations, the rotation of the shaft 14 and/or bearing 18 may fling or force the fluid upward into the fluid outlet passage 90 against the force of gravity. In a number of variations, the housing bore 170 may drain fluid accepted from the fluid outlet passage 90 over high temperature surfaces on the turbine side 42 of the product 100. In a number of variations, the housing bore 170 may be a cast void that drains into a cast area outside of the bearing 18 and/or bearing housing 19. In a number of variations, this may wet and sufficiently cool the housing bore 170 and/or bearing 18, bearing housing 19 or cast area outside of the bearing 18, or bearing housing 19. In a number of variations, the product 10 or bearing housing 19 may include a pressurized volume 95. In a number of variations, the pressurized volume 95 may be constructed and arranged to flow fluid upward to the top side of the bearing housing 19 through the at least one fluid outlet passage 90. Referring to FIG. 3, in a number of variations, the at least one fluid outlet passage 90 may be offset in the radial direction along radial axis 16*b* from the plane of the longitudinal passageway 102. In a number of variations, the cross-sectional shape of the longitudinal passageway 102, fluid inlet passages 78, 79, at least one fluid outlet passage 90, or the secondary fluid outlet passages 178, 179 may be any shape including a circle, polygon, ellipse, or may be a different cross-sectional shape. In a number of variations, the width of the longitudinal passageway 102, fluid inlet passages 78, 79, at least one fluid outlet passage 90, or the secondary fluid outlet passages 178, 179 may be varied along the length of the individual component.

In a number of variations, the product 10 including any of its components (including, but not limited to, the bearing 18, shaft 14, compressor wheel 41, turbine wheel 43, bearing housing 19 (including the fluid delivery system 200 components), or another component) may be made of aluminum, cast iron, injection molded plastic, die cast metal, or other suitable material used for constructing rotational devices and bearings. In a number of variations, the components of the product 10 (including, but not limited to, the bearing 18, shaft 14, compressor wheel 41, turbine wheel 43 or another component) may be secured in the orientations illustrated by staking, casting it in position, or other suitable means.

In a number of variations, a method is shown. In a number of variations, the method may include providing a product 10 comprising a rotor 12 comprising a shaft 14 having a rotation axis 16*a*, a bearing 18 at least partially surrounding the shaft 14 allowing for rotation of the shaft 14 within the bearing 18 about the rotation axis 16*a*, and a bearing housing 19 comprising at least one fluid outlet passage 90 constructed and arranged to flow fluid upward from the bearing 18 to a top side 19A of the bearing housing 19. In a number of variations, the method may further include flowing fluid through the least one fluid outlet passage 90 upward from the bearing 18 to a top side 19A of the bearing housing 19 while the shaft 14 is in rotation.

In a number of variations, the product 10 including at least one fluid outlet passage 90 may allow for decreased heat transfer to the compressor end 40 of the product including the compressor wheel 41. In a number of variations, this may lessen the bearing 18 and bearing housing 19 temperatures that may increase oil viscosity and help eliminate oil and fluid cooking. In a number of variations, the product 10 or method 800 may provide a flowing of fluid from the bearing 18 through the fluid outlet passage 90 to the housing bore 170 where it may be redirected to the turbine 42, 41 of the product 10. In a number of variations, this may increase the temperature of the fluid while decreasing the temperature of the product 10 components while not increasing fluid flow. In a number of variations, the product 10 or method 800 may not influence the initial fluid being fed to the product 10.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and still are considered to be within the scope of the invention.

Variation 1 may include a product comprising a rotor comprising a shaft having a rotation axis, a bearing at least partially surrounding the shaft allowing for rotation of the shaft within the bearing about the rotation axis, and a bearing housing comprising at least one fluid outlet passage constructed and arranged to flow fluid upward from the bearing to a top side of the bearing housing.

Variation 2 may include the product according to Variation 1 wherein the bearing housing further comprises a pressurized volume that is constructed and arranged to flow fluid upward to the top side of the housing through the at least one fluid outlet passage.

Variation 3 may include the product according to any of Variations 1 to 2 wherein the product is a turbocharger and wherein the shaft comprises a compressor end comprising a compressor wheel, and a turbine end comprising a turbine wheel.

Variation 4 may include the product according to any of Variations 1 to 3 wherein the top side of the bearing housing further comprises at least one housing bore constructed and arranged to accept fluid from the at least one fluid outlet passage.

Variation 5 may include the product according to any of Variations 1 through 3 wherein the bearing comprises a rolling element bearing.

Variation 6 may include the product according to any of Variations 1 through 5 wherein the bearing comprises at least one journal bearing.

Variation 7 may include the product according to any of Variations 1 through 6 wherein bearing housing further comprises a fluid drain.

Variation 8 may include the product according to any of Variations 1 through 7 wherein bearing housing further comprises a fluid inlet.

Variation 9 may include the product according to Variation 8 wherein the bearing housing comprises at least one fluid inlet passage constructed and arranged to provide fluid to the bearing from the fluid inlet.

Variation 10 may include a product according to any of Variations 4 through 9 wherein the housing bore provides fluid to a fluid drain.

Variation 11 may include a method comprising providing a product comprising a rotor comprising a shaft having a rotation axis, a bearing at least partially surrounding the shaft allowing for rotation of the shaft within the bearing about the rotation axis, and a bearing housing comprising at least one fluid outlet passage constructed and arranged to flow fluid upward from the bearing to a top side of the bearing housing; and flowing fluid through the least one fluid outlet passage upward from the bearing to a top side of the bearing housing while the shaft is in rotation.

Variation 12 may include the method according to Variation 11 wherein the bearing housing further comprises a pressurized volume that is constructed and arranged to flow fluid upward to the top side of the housing through the at least one fluid outlet passage.

Variation 13 may include the method according to any of Variations 11 to 12 wherein the product is a turbocharger and wherein the shaft comprises a compressor end comprising a compressor wheel, and a turbine end comprising a turbine wheel.

Variation 14 may include the method according to any of Variations 11 through 13 wherein the top side of the bearing housing further comprises at least one housing bore constructed and arranged to accept fluid from the at least one fluid outlet passage.

Variation 15 may include the method according to any of Variations 11 through 14 wherein the bearing comprises a rolling element bearing.

Variation 16 may include the method according to any of Variations 11 through 15 wherein the bearing comprises at least one journal bearing.

Variation 17 may include the method according to any of Variations 11 through 16 wherein the bearing housing further comprises a fluid drain.

Variation 18 may include the method according to any of variations 11 through 17 wherein bearing housing further comprises a fluid inlet.

Variation 19 may include the method according to variation 18 wherein the bearing housing comprises at least one fluid inlet passage constructed and arranged to provide fluid to the bearing from the fluid inlet.

Variation 20 may include the method according to any of variations 14 through 19 wherein the housing bore provides fluid to a fluid drain.

The above description of select variations within the scope of the invention is merely illustrative in nature and, thus, variations or variants thereof are not to be regarded as a departure from the spirit and scope of the invention.

What is claimed is:

1. A product comprising: a rotor comprising a shaft having a rotation axis, a bearing comprising a rolling element bearing, the bearing at least partially surrounding the shaft allowing for rotation of the shaft within the bearing about the rotation axis, and a bearing housing comprising a top portion and a bottom portion, wherein the top portion comprises at least one fluid outlet passage and at least one housing bore, and wherein the housing bore is constructed and arranged to accept fluid from the at least one fluid outlet passage and wherein the at least one fluid outlet passage is constructed and arranged to flow fluid upward from the bearing to the top portion of the bearing housing; and wherein the product is a turbocharger and wherein the shaft comprises a compressor end comprising a compressor wheel, and a turbine end comprising a turbine wheel, and wherein the at least one housing bore extends in the axial direction of the shaft toward the turbine wheel and is constructed and arranged to flow fluid toward the turbine wheel to increase the temperature of the fluid during operation of the turbocharger.

2. The product as set forth in claim 1 wherein the bearing housing further comprises a pressurized volume that is constructed and arranged to flow fluid upward to the top portion of the housing through the at least one fluid outlet passage.

3. The product as set forth in claim 1 wherein the bearing comprises at least one journal bearing.

4. The product as set forth in claim 1 wherein the bearing housing further comprises a fluid drain.

5. The product as set forth in claim 1 wherein the bearing housing further comprises a fluid inlet.

6. The product as set forth in claim 5 wherein the bearing housing comprises at least one fluid inlet passage constructed and arranged to provide fluid to the bearing from the fluid inlet.

7. The product of claim 1 wherein the at least one housing bore provides fluid to a fluid drain.

8. A method comprising:

providing a product comprising a rotor comprising a shaft having a rotation axis, a bearing comprising a rolling element bearing, the bearing at least partially surrounding the shaft allowing for rotation of the shaft within the bearing about the rotation axis, and a bearing housing comprising at least one housing bore defined by an inner surface of a top side of the bearing housing and at least one fluid outlet passage in operative communication with the at least one housing bore constructed and arranged to flow fluid upward from the bearing to the at least one housing bore;

flowing fluid through the at least one fluid outlet passage upward from the bearing to the top side of the bearing housing while the shaft is in rotation; and wherein the product is a turbocharger and wherein the shaft comprises a compressor end comprising a compressor wheel, and a turbine end comprising a turbine wheel, and wherein the at least one housing bore extends in the axial direction of the shaft toward the turbine wheel and is constructed and arranged to flow fluid toward the turbine wheel to increase the temperature of the fluid during operation of the turbocharger.

9. The method as set forth in claim 8 wherein the bearing housing further comprises a pressurized volume that is constructed and arranged to flow fluid upward to the top side of the housing through the at least one fluid outlet passage.

10. The method as set forth in claim 8 wherein the bearing comprises at least one journal bearing.

11. The method as set forth in claim 8 wherein the bearing housing further comprises a fluid drain.

12. The method as set forth in claim 8 wherein the bearing housing further comprises a fluid inlet.

13. The method as set forth in claim 12 wherein the bearing housing comprises at least one fluid inlet passage constructed and arranged to provide fluid to the bearing from the fluid inlet.

14. The method of claim 8 wherein the at least one housing bore provides fluid to a fluid drain.

15. A turbocharger comprising:

a rotor comprising a shaft having an axis of rotation;

a turbine wheel attached to a first end of the shaft and a compressor wheel attached to a second end of the shaft;

a bearing at least partially surrounding the shaft constructed and arranged to allow for rotation of the shaft within the bearing about the axis of rotation;

a bearing housing surrounding at least a portion of the bearing, wherein the bearing housing comprises a compressor side and a turbine side;

a fluid delivery system comprising a fluid inlet, a longitudinal passageway, at least one fluid inlet passage in operative communication with the longitudinal passageway constructed and arranged to deliver fluid to at least one of the bearing or the shaft, at least one bore defined by an inner surface of the bearing housing which extends through a top portion of the bearing housing, at least one fluid outlet passage in operative communication with the at least one bore; and wherein the at least one bore is constructed and arranged to accept fluid from the at least one fluid outlet passage and wherein the at least one fluid outlet passage is constructed and arranged to flow fluid upward from the bearing to the top portion of the bearing housing, and wherein the at least one bore extends in the axial direction of the shaft toward the turbine wheel and is constructed and arranged to flow fluid toward the turbine wheel to increase the temperature of the fluid during operation of the turbocharger.

16. The turbocharger as set forth in claim 15 wherein the at least one bore is disposed along the axis of rotation.

17. The product as set forth in claim 1 wherein the at least one housing bore is disposed along the rotation axis.

18. The method as set forth in claim 8 wherein the at least one housing bore is disposed along the rotation axis.

* * * * *